United States Patent [19]

Treby et al.

[11] 4,452,567

[45] Jun. 5, 1984

[54] ROTOR DRIVE SYSTEMS

[75] Inventors: John M. Treby; Derek A. Roberts, both of Bristol, England

[73] Assignee: Rolls-Royce Limited, London, England

[21] Appl. No.: 278,675

[22] Filed: Jun. 29, 1981

[30] Foreign Application Priority Data

Jul. 15, 1980 [GB] United Kingdom ..... 8023032

[51] Int. Cl.[3] ..... F01D 5/02

[52] U.S. Cl. ..... 416/2; 416/170 R; 416/204 A; 415/9; 60/226.1

[58] Field of Search ..... 60/226 R, 39.31, 39.32, 60/39.091; 416/204 A, 170 R, 174; 464/2, 210 A, 92, 32, 183, 158; 403/359; 415/9

[56] References Cited

U.S. PATENT DOCUMENTS

| | | | |
|---|---|---|---|
| 3,399,549 | 9/1968 | Nagele | 403/359 |
| 3,466,895 | 9/1969 | Cartwright . | |
| 3,727,998 | 4/1973 | Haworth et al. | 416/170 R |
| 3,914,067 | 11/1975 | Leto . | |
| 3,938,398 | 2/1976 | Bloom et al. | 403/359 |
| 4,127,080 | 11/1978 | Lakiza et al. | 464/97 |
| 4,193,741 | 3/1980 | Briggs | 60/226 R |
| 4,201,513 | 5/1980 | Sales | 60/226 R |

FOREIGN PATENT DOCUMENTS 1556266 11/1979 United Kingdom .

*Primary Examiner*—Carlton R. Croyle
*Assistant Examiner*—Jeffrey A. Simenauer
*Attorney, Agent, or Firm*—Parkhurst & Oliff

[57] ABSTRACT

A fan drive system comprising a main drive shaft 13 which drives the fan through a frangible coupling 27 and an auxilliary drive shaft 30 which by-passes the coupling 27. The auxilliary shaft 30 is pre-twisted elastically in the opposite direction to the direction of rotation of the main shaft 13, and is held in the pre-twisted state by the coupling 27. When the coupling 27 disconnects the drive from the main shaft 13, for example when the fan becomes unbalanced and transverse loads exceed a predetermined magnitude, the auxilliary shaft 30 unwinds. Unwinding of the shaft 30 cushions the fan against suddenly applied loads when the coupling 27 breaks and also reduces the loads on the coupling 27 during normal balanced running.

4 Claims, 3 Drawing Figures

ROTOR DRIVE SYSTEMS

DESCRIPTION

This invention relates to the supporting and driving of rotors of gas turbine engines, and is particularly concerned with the problem of supporting and driving such rotors when the mass of the rotor becomes unbalanced and inversion of the rotor is permitted.

Imbalance of rotors, such as large compressor fans of gas turbine engines, can occur when part, or whole, of a fan blade becomes detached from the fan disc whilst the engine is running.

When a blade is lost the rotor experiences a large out-of-balance load which causes the rotor to orbit bodily about its original axis of rotation.

A number of prior proposals for coping with unbalanced running of the rotor have been suggested in the past. In many of these earlier proposals the rotor is driven by a main shaft via a frangible coupling which breaks when the rotor becomes unbalanced. An auxiliary shaft is usually provided to transmit torsional drive to the rotor when the coupling breaks. This auxiliary shaft is usually very flexible in bending compared to the main shaft and ideally is stiff in torsion.

One of the problems with using auxiliary drive shafts with different longitudinal and torsional flexibility compared with the main drive shaft is that when the coupling breaks there is suddenly applied torque on the auxiliary drive shaft which may permanently twist or shear the auxiliary drive shaft or subject the rotor to a violent increase in torque at the moment that the rotor starts to orbit. This suddenly applied torque accentuates the out of balance forces and may cause further damage to the rotor by causing the rotor to move further off center and strike surrounding structure.

In addition to the above, a problem with using frangible couplings is that the coupling must be capable of withstanding suddenly applied variations in torque, due for example to the fan blades striking an ingested bird, without the coupling breaking unless the transverse loads due to unbalanced running exceed a predetermined value. It has been found that with couplings employing shear pins, the shear stress on the pins can increase by as much as a further 100% above the normal stress if the blades strike a large bird.

An object of the present invention is to lessen the deleterious effects of suddenly applied torque loads on the auxilliary drive shaft and the frangible coupling.

According to the present invention there is provided a gas turbine engine comprising a main shaft, a rotor, a frangible coupling interconnecting the main shaft and the rotor through which a primary torsional drive is transmitted from the main shaft to the rotor, the coupling being designed to disconnect the primary drive from the main shaft to the rotor when transverse loads on the rotor exceed a predetermined magnitude, and an auxiliary drive shaft connected to the main shaft and to the rotor to provide a secondary drive path between the main shaft and the rotor when the coupling disconnects the primary drive between the main shaft and the rotor, the auxiliary shaft being more flexible in bending than the main shaft, characterised in that the auxiliary shaft is pre-twisted in the opposite direction to the direction of rotation of the main shaft, and constraining means are provided to constrain the auxiliary shaft in the pre-twisted state until the coupling disengages the primary drive to the rotor so that when the coupling disengages the primary drive, the auxiliary drive shaft tends to unwind itself.

Preferably the constraining means is constituted by the coupling. Alternatively the constraining means may be additional to the coupling.

The invention will now be described by way of an example only with reference to the accompanying drawings, in which.

Figure 1:
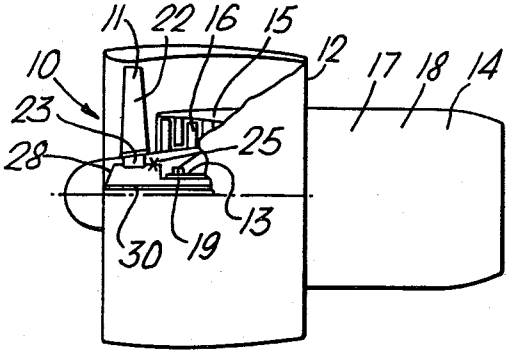
FIG. 1 is a schematic illustration of a gas turbine aero engine incorporating the present invention.

Referring now to the drawings, FIG. 1 shows a ducted fan engine 10 having a front fan rotor 11 mounted for rotation in a by-pass duct 12. The fan 11 is mounted on one end of the main drive shaft 13 which is driven by a turbine 14. The turbine 14 is itself driven by an efflux of gases from a gas generator or core engine 15. The gas generator is of conventional design and includes one or more further compressors 16, combustion equipment 17 and turbines 18.

Figure 2:
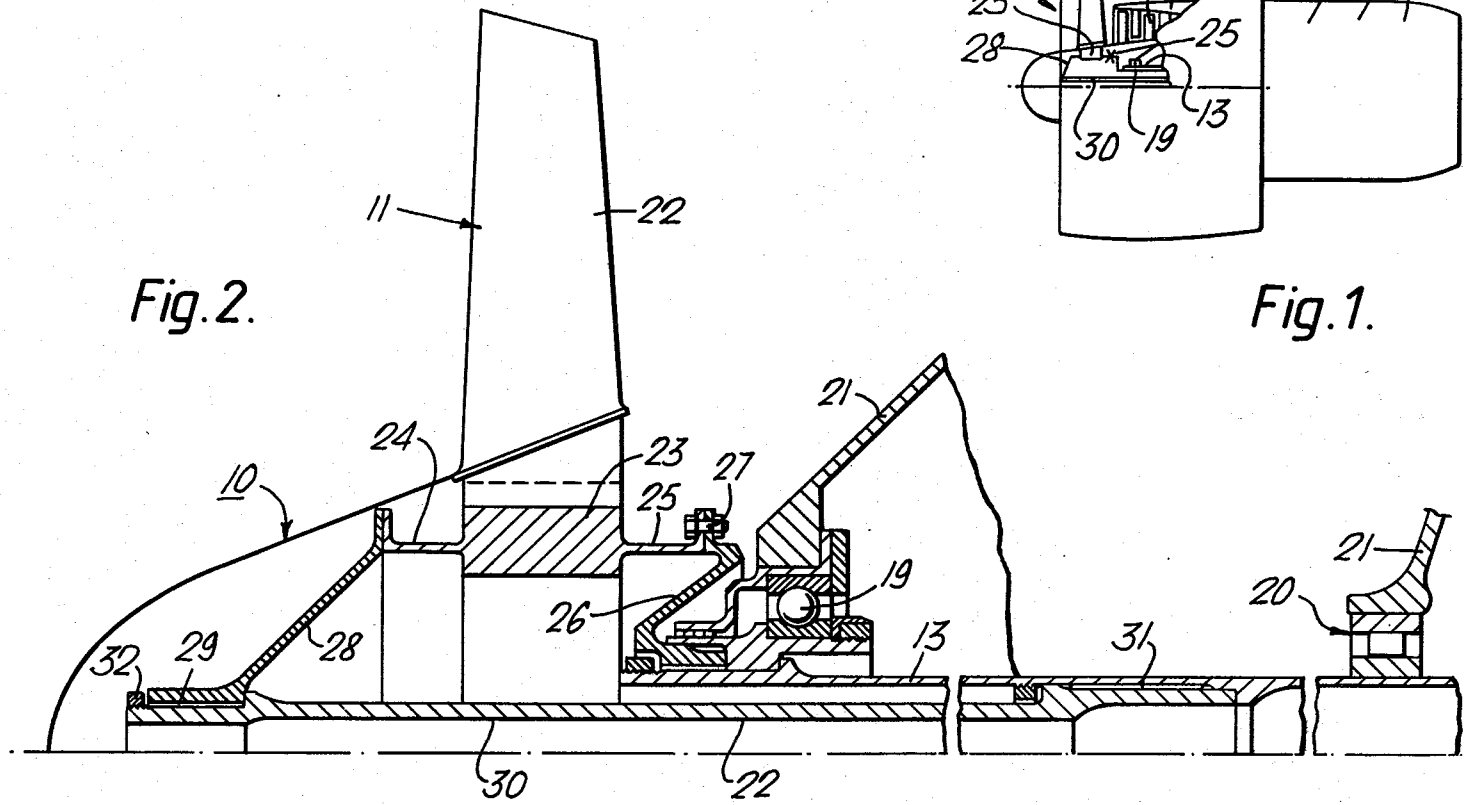
FIG. 2 shows in greater detail a part sectional elevation of the front fan assembly of the engine of FIG. 1.

Referring to FIG. 2 the main drive shaft 13 is supported in two main bearings 19,20 carried by fixed structure 21 of the engine casing. The front bearing 19 is a ball race thrust bearing and the rear bearing 20 is a roller race journal bearing. The turbine 14 (not shown in FIG. 2) is mounted on the main drive shaft 13 in a conventional manner at a location in front of the rear bearing 20.

Preferably the auxilliary shaft is located in the bore of a hollow main shaft and is connected at one of its ends to the main shaft.

The fan rotor 11 comprises a plurality of fan blades 22 mounted around the perimeter of a hub 23 by conventional fir tree root fixings. The hub 23 has two cylindrical flanges 24,25 each of which is provided with a radially extending flange.

The fan rotor 11 is supported in bearing 19 by means of a housing 26 which is bolted to the flange 25 by means of shear bolts 27. The shear bolts 27 constitute a frangible coupling which is designed to fracture should transverse loads on the rotor 11 exceed a predetermined magnitude as described below. The front flange 24 of the hub 23 is bolted to a conical front housing 28 which is provided with internal splines 29.

An auxilliary shaft 30 is fixed on splines 31 within the bore of the main shaft 13 and projects forward beyond the front bearing 19. The shaft 30 is provided with splines at its front end that mate in the splines 29 of the front housing 28 and is secured in place on the splines by means of a nut 32. The shaft 30 is torsionally stiff, that is to say that torque developed by the turbine 14 can be transmitted by the shaft 30 to the front fan rotor 11 when the frangible bolts 27 break.

During assembly, the front end of the auxilliary shaft 30 is pre-twisted elastically in the opposite direction to the direction of rotation of the rotor 11 in use. The auxilliary shaft 30 is constrained to remain in the pre-twisted state all the time that the frangible coupling, constituted by the shear bolts 27, transmits primary drive from the shaft 13 through housing 26 to the rotor. Therefore, it will be seen that the frangible coupling effectively constrains the auxilliary shaft 30 to remain in the pre-twisted state.

The auxilliary shaft 30 is stiff in torsion and more flexible in bending than is that shaft 13 and constitutes a secondary drive path from the shaft 13 to the rotor 11 when the frangible coupling breaks. The flexibility of the shaft 30 allows the rotor to orbit relative to the shaft 13, should the rotor become unbalanced. As soon as the transverse loads on the rotor exceed a predetermined magnitude, due for example to part or whole of a blade becoming damaged or knocked off by debris, the shear pins 27 fracture allowing the shaft 30 to transmit the applied torque from the shaft 13. The suddenly applied torque is cushioned by the unwinding of the auxilliary shaft 30.

If desired, flexible resilient pads may be provided between the shaft 13 and the shaft 30 to provide shock absorption and damping.

Shaft 30 is pre-twisted in any convenient manner. For example, shear bolts 27 of the frangible coupling can be removed, and the fan can be rotated while holding main drive shaft 13 stationary. Once a twist is introduced into shaft 30, the shear bolts are replaced.

By pre-twisting the shaft 30 in the opposite direction to the direction of rotation of the shaft 13, the shear bolts 27 are always under a load, during balanced running, which ensures that the splines 29,31 are always loaded on the same faces. This gives a more balanced assembly. In addition, the "spring-back" of shaft 30 pre-loads the shear bolts say to 100% of their designed stress, so that when the rotor rotates the gas loads on the blades reduce this pre-loading to say, for example, 25% of the designed stress. When the blades strike heavy objects such as birds or debris which are insufficient to unbalance completely the rotor, then the shear stress on the bolts is further reduced and reverses to say 75% of the designed stress. If the blades strike a large enough object to knock off part or all of one or more blades, then the centre of mass of the rotor changes, and the shear bolts 27 are subjected to loads transverse to the shafts 13,30 and they break. The bolts 27 are designed to shear when the transverse loads exceed a predetermined magnitude. The actual value of this level will depend upon the torque to be transmitted by the coupling, the number of bolts 27, the amount of damage to the rotor that can be tolerated before the rotor becomes too unbalanced, the speed of rotation of the rotor, the amount of pre-twist in the shaft 30 and the torsional stiffness of shafts 30 and 13.

The pre-twisting further functions to cushion auxiliary shaft 30, and consequently fan 22, from a suddenly applied load torque upon breakage of the frangible coupling 27. While in its twisted state, shaft 30 delivers substantially no torque from main drive shaft 13 to fan 22. With coupling 27 intact, the power path is essentially from shaft 13 directly to the fan.

Upon breakage of the coupling, the auxiliary shaft 30 is suddenly confronted with a reaction load torque from the blades in a direction opposite to the rotation of the blades. As a result, shaft 30 has a tendency to twist in a direction opposite to the direction of rotation until it is torqued up to full torque by the main drive shaft. The unwinding action of shaft 30 resulting from the pre-twist counteracts this twist in the direction opposite to the direction of rotation, thus cushioning the suddenly applied torque.

Nevertheless, to a person skilled in the design of rotating spools of turbomachines and in possession of the present invention, it is well within his skills to arrive at a design of a turbomachine spool which meets specific design requirements.

Figure 3:
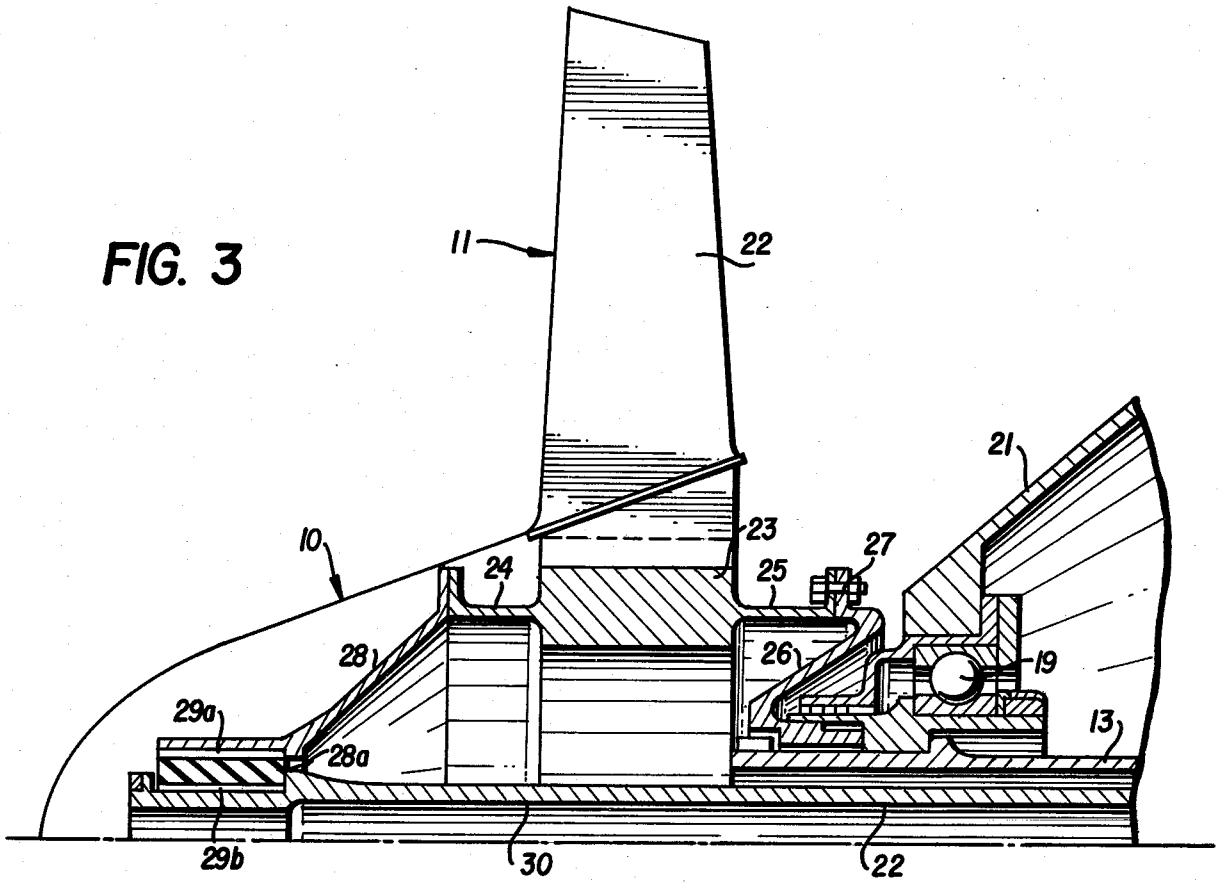
FIG. 3 is a schematic illustration of an alternative embodiment of the present invention.

In the above-described example the means to constrain the shaft 30 in the pre-twisted state is constituted by the frangible coupling. If desired, a constraining means separate to the coupling may be employed. For example, as shown in FIG. 3, an intermediate member **28*a* may be provided concentrically between the front end of shaft 30 and the housing 28. Such an intermediate member may be a hollow cylindrical sleeve with one set of internal splines 29*b* in its bore to mate with the splines on the shaft 30 and a second set of external 29*a* on its outer circumference which mates with the splines on the housing 28. The internal splines 29*b* are slightly out of phase with the external splines 29*a* to an extent corresponding to the desired pre-twist in auxiliary shaft 30. In this embodiment, the pre-twist is induced into the shaft without removing shear bolts 27 of the frangible coupling. Instead, housing 28 is merely rotated with respect to auxiliary shaft 30 and intermediate member 28*a*** is inserted to maintain this relative rotation.

We claim:

1. A gas turbine engine comprising a main shaft; a rotor; a frangible coupling interconnecting the main shaft and the rotor and through which a primary torsional drive is transmitted from the main shaft to the rotor, said coupling designed to disconnect the primary drive from the main shaft to the rotor when radial loads on the rotor exceed a predetermined magnitude; an auxiliary drive shaft connected at a first end to the main shaft and at a second end to the rotor to provide a secondary drive path between the main shaft and the rotor when the coupling disconnects the primary drive betwen the main shaft and the rotor, the auxiliary shaft being more flexible in bending than the main shaft and having its second end pre-twisted elastically in the opposite direction to the direction of rotation of the main shaft; and constraining means to constrain the auxiliary shaft in the pre-twisted state until the coupling disengages the primary drive to the rotor so that when the coupling disengages the primary drive, the auxiliary drive shaft tends to unwind itself, thus cushioning suddenly applied load torque of said auxiliary shaft.

2. A gas turbine engine according to claim 1 wherein the constraining means is comprised of the coupling.

3. A gas turbine engine according to claim 1 wherein the constraining means is comprised of means other than the coupling.

4. A gas turbine engine according to claim 1, wherein said main shaft has a bore therein, said auxiliary shaft being located within said bore in said main shaft.

* * * * *